United States Patent [19]

Jaffa

[11] 3,977,322

[45] Aug. 31, 1976

[54] SCREEN PRINTER WITH PALLET WORK SUPPORT

[75] Inventor: David Jaffa, Fairlawn, N.J.

[73] Assignee: Precision Screen Machines Inc., Hawthorne, N.J.

[22] Filed: Aug. 26, 1974

[21] Appl. No.: 500,406

[52] U.S. Cl. ..... 101/126; 198/181

[51] Int. Cl.[2] ..... B41F 15/26

[58] Field of Search ..... 101/115, 116, 118, 123, 101/124, 126, 35, 44; 198/181, 182, 131

[56] References Cited

UNITED STATES PATENTS

| | | | |
|---|---|---|---|
| 2,609,086 | 9/1952 | McBride et al. | 198/181 X |
| 2,848,102 | 8/1958 | Whitney | 198/181 |
| 3,249,045 | 5/1966 | Karlyn | 101/126 X |
| 3,311,051 | 3/1967 | Rudolph et al. | 101/126 X |
| 3,706,371 | 12/1972 | Hirota | 198/181 |
| 3,752,070 | 8/1973 | Jaffa | 101/123 |
| 3,763,776 | 10/1973 | Jaffa | 101/126 X |
| 3,795,189 | 3/1974 | Jaffa | 101/126 X |

*Primary Examiner*—Edgar S. Burr
*Assistant Examiner*—R. E. Suter
*Attorney, Agent, or Firm*—Philip D. Amins

[57] ABSTRACT

A printing machine such as a screen printing machine having a series of pallets connected to an endless drive whereby the pallets are sequentially advanced to a printing station. The improvements reside in an arrangement in which the article support portion of the pallets are rendered readily removable to provide for interchangeability and which pallets have connected thereto guide rollers for laterally stabilizing the pallets as they advance through a printing station. An anti-whipping device is also operatively associated with the respective pallets to prohibit whipping the pallets round the ends of the endless drive, and a support arrangement is provided for supporting the pallets traveling along the lower flight of the endless drive.

13 Claims, 8 Drawing Figures

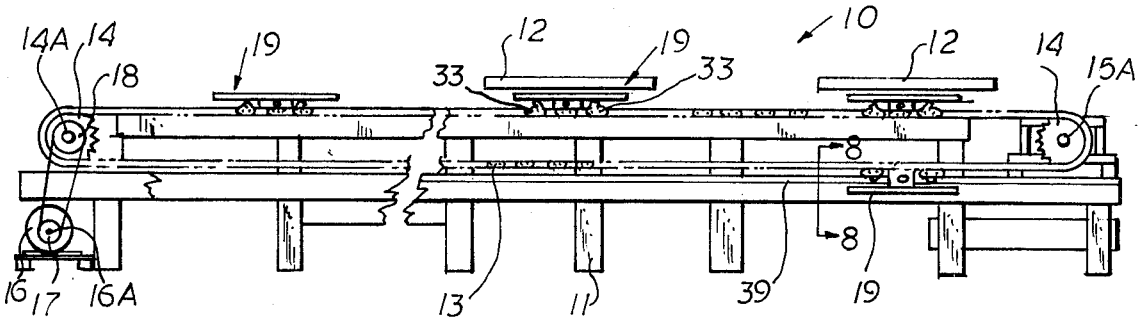
FIG. 1
FIG. 5
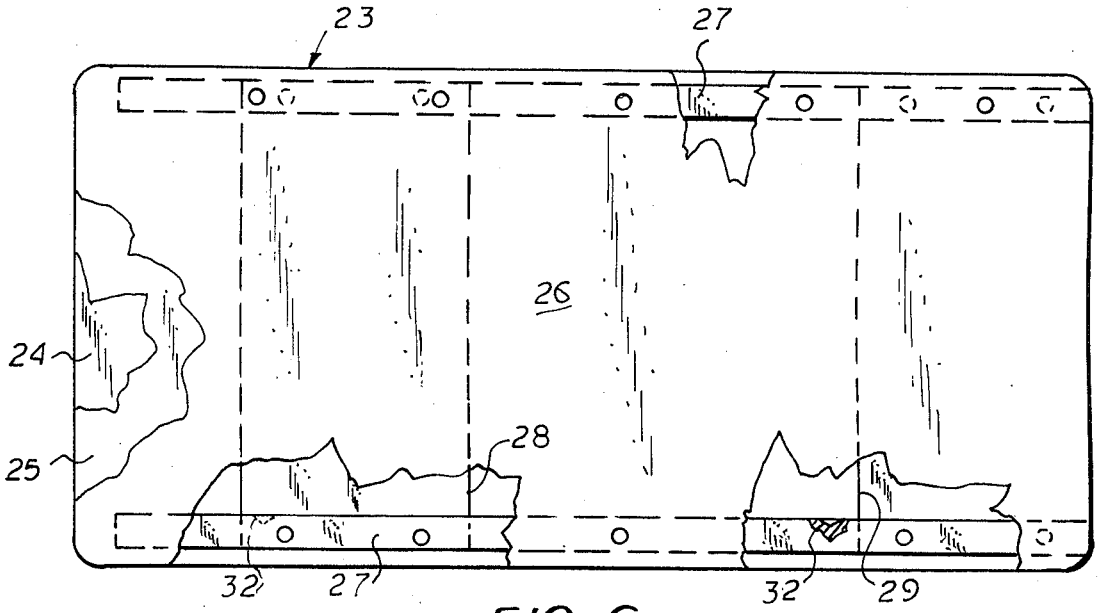
FIG. 6
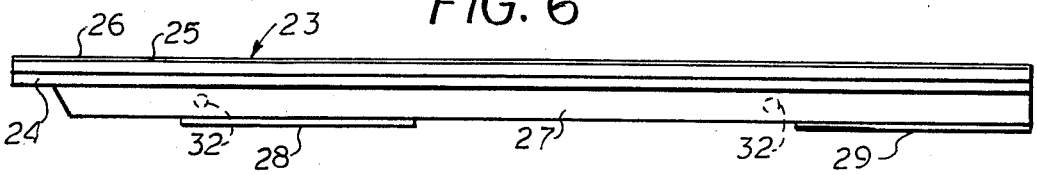
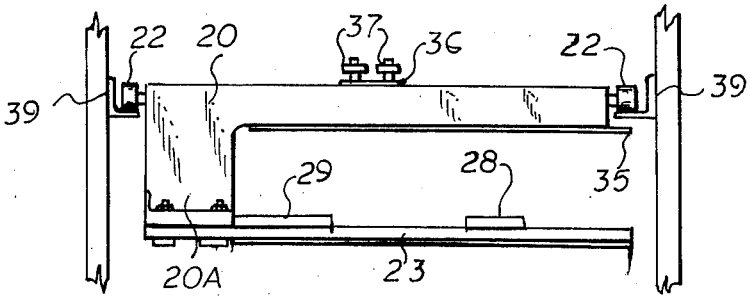
FIG. 8

SCREEN PRINTER WITH PALLET WORK SUPPORT

PROBLEM AND PRIOR ACT

It is known that there exist various types of screen printing apparatuses. One such apparatus which is particularly adapted for screen printing discrete articles of fabrics, such as T-shirts, and/or cut fabric pieces comprises an endless drive to which there is connected a series of pallets which are indexed so as to be sequentially advanced through a printing station. Generally the endless drive comprises a drive chain to which the pallets are connected at spaced intervals. In the known apparatus of this type there has been noted certain inherent undesirable characteristics. The observed and noted disadvantages in machines of this type is that they were not provided with interchangeable pallets so as to accommodate various sizes and/or shapes of articles to be printed. Also because of the nature of the known pallet type screen printing machine there was a tendency for the pallets to be laterally shifted as there were successively indexed thereby causing some disorientation to occur in registration between the article to be printed and the printing screen. Also due to the weight and mass of the respective pallets, there resulted an undesirable elongation of the drive means after a period of use which ultimately resulted in improper registration. Also due to the desired high speed operation of such machine, whipping of the pallets in rounding the ends of the endless drive, due to the mass and inherent inertia thereof, resulted in considerable banging and noise. Such banging imposed severe stresses on the overall apparatus resulting in undue damage, noise, and vibration.

OBJECTS

An object of this invention is to provide in a pallet type screen printing machine an arrangement in which the pallets can be readily interchanged with a maximum of ease.

Another object is to provide a printing machine with an improved pallet construction which is releasably connected to provide a maximum of versatility in the use and application of the machine.

Another object is to provide in a pallet type printing machine maximum laterally stability of the pallets as the respective pallets are indexed through a printing station.

Another object is to minimize the whipping action of the pallets in a pallet screen printing machine as the pallets round the ends of the endless drive.

Another object is to provide an arrangement in which the tendency to stretch of the endless drive of such printing machine is minimized to result in a more accurate and positive registration.

BRIEF SUMMARY OF THE INVENTION

The foregoing objects and other features and advantages are obtained in a printing machine in which a plurality of pallets are connected to an endless drive whereby the respective pallets are successively indexed through a printing station of the printing machine. The respective pallets are constructed with an article support portion constructed so as to be readily releasable so that the article support portion can be readily interchangeable to accommodate articles to be printed of various shapes and/or sizes. Also a locking means is provided for releasably securing the article support portion to its base member.

The base member of the pallet is further provided with lateral stabilizing means to minimize any lateral displacement of the respective pallets as they are indexed through the printing station of the apparatus. Also support rails are provided for supporting the pallets being indexed along the lower flight of the endless drive. In this manner any elongation of the drive is prohibited, thereby ensuring more accurate indexing. Cooperatively associated with the base member of the respective pallets are bumper means which cooperate therewith to minimize whipping of the pallets as they successively round the ends of the endless drive.

FEATURES

A feature of this invention resides in the provision of a pallet having a base member connected to an endless drive and an article supporting portion which is releasably secured to the base member whereby the article support portion is rendered readily interchangeable.

Another feature resides in providing the respective pallets with a lateral stabilizing guide to laterally stabilize the pallets as they are indexed through a printing station.

Another feature resides in the provision of bumpers cooperatively associated with the base member of the respective pallets to prohibit whipping of the pallets as they round the ends of the endless drive.

Another feature resides in the provision of support rails for supporting the weight of the respective pallets when travelling along the lower flight of the endless drive.

Other features and advantages will become more readily apparent when considered in view of the drawings in which:

FIG. 1 is a side elevation view of a printing apparatus embodying the invention, having parts broken away and/or diagrammatically illustrated.

FIG. 5 is a top plan detail view of the article support portion of the pallet.

FIG. 6 is an end elevation view of FIG. 5.

FIG. 8 is an end elevation view taken along line 8—8 on FIG. 1.

DETAILED DESCRIPTION

Figure 2:
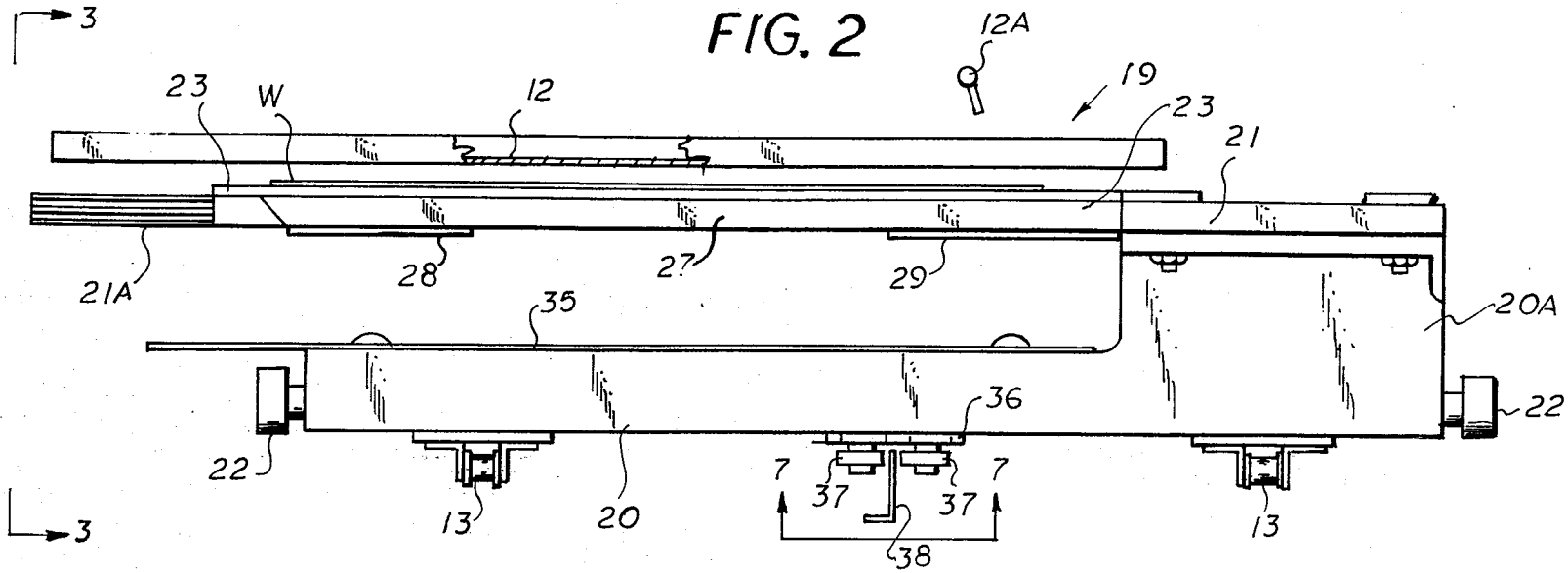
FIG. 2 is an end elevation view of the pallet construction used in the apparatus of FIG. 1.

Referring to the drawings there is shown in FIG. 1, a printing machine 10 illustrating the present invention. For purposes of description, the printing machine 10 is illustrated as a screen printing machine which includes a supporting frame structure 11 on which one or more printing screens 12 and associated squeegees 12A are mounted. Each screen 12 and associated squeegee 12A defines a printing station.

Mounted on the frame 11 is an endless drive, which is illustrated as a chain 13 or the like threaded over end sprockets 14, 15 which are rotatably journaled to suitable axles 14A, 15A. It will be understood that a pair of opposed chains 13, 13, as seen in FIG. 2 are preferred, each being threaded about complementary sprockets 14 and 15.

The means for energizing the chain drive 13, 13 may comprise a motor 16, the output shaft 16A of motor 16 having a driving sprocket 17 connected in driving relationship to a driving sprocket 18 suitably connected to axle 14A by a flexible drive threaded to sprockets 17 and 18. Thus when the motor is activated the drive thereof is transmitted to the axles 14A and associated sprocket to drive chain 13, 13, whereby the pallets mean 19 are indexed through a printing station.

Figure 3:
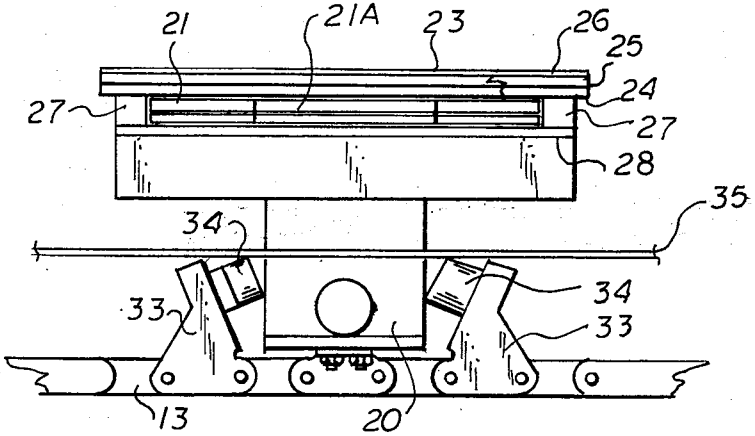
FIG. 3 is a side elevation view of the pallet of FIG. 2.
Figure 4:
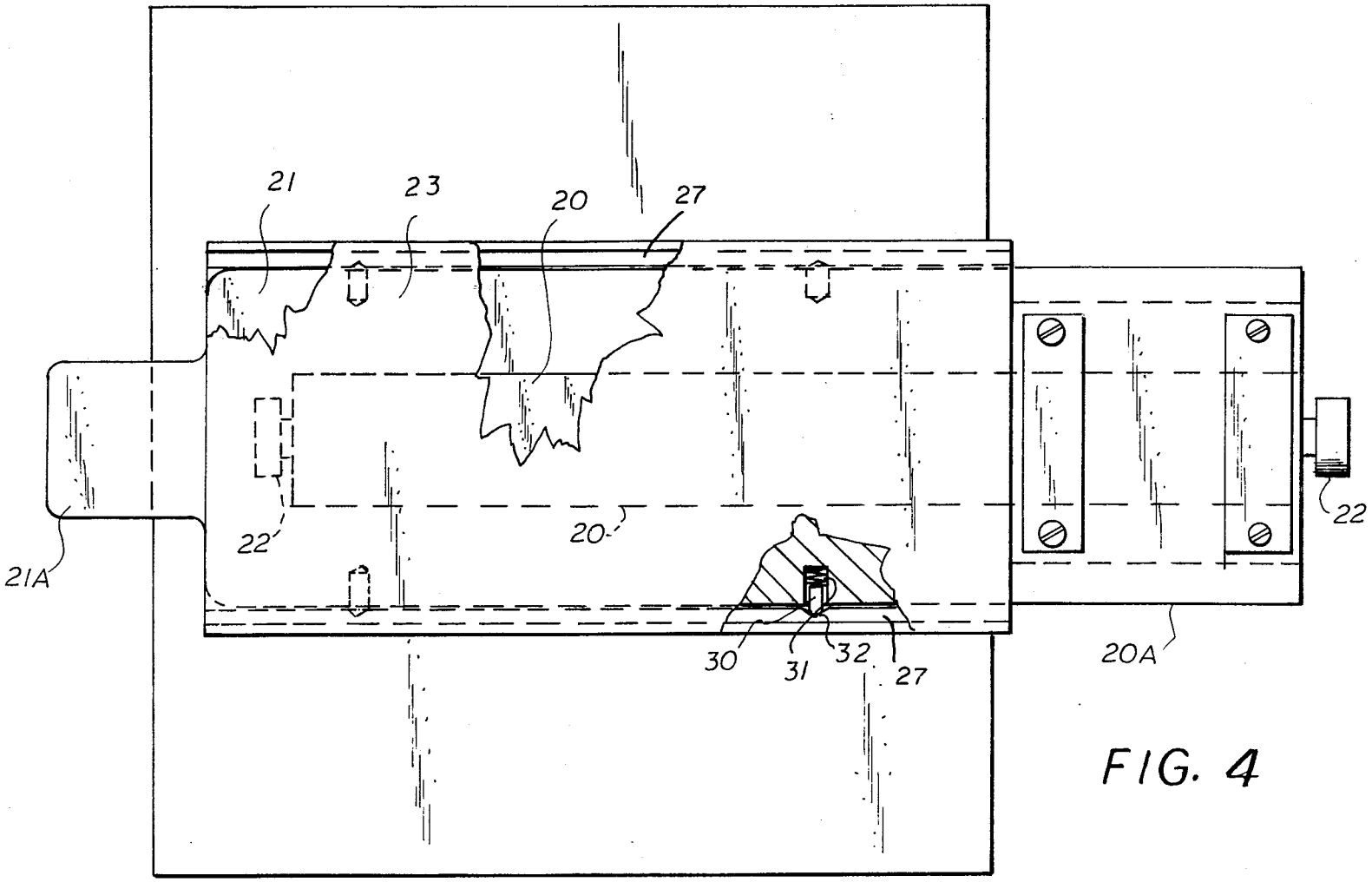
FIG. 4 is a top plan view of the pallet of FIG. 2.

A plurality of pallet means or members 19 are connected along the respective drive chain 13, 13 at spaced intervals therealong. Referring to FIGS. 2, 3, 4 and 5, each pallet means 19 comprises a base member 20 which is suitably secured to the respective drive chains 13, 13 at spaced intervals therealong. At best seen in FIG. 1 the respective pallet means 19 are connected to the endless chain 13, 13 defined by an upper flight and a lower flight, the respective pallet means 19 being successively indexed as the chain drive is actuated. One end of the base member 20 is provided with a raised portion 20A adjacent one end thereof of which a support arm 21 is cantileveraly supported thereon. As shown, the base member 20 and connected support arm 21 are disposed in spaced relationship and extend in a direction normal to the movement of the chain drive 13, 13. Connected to the opposed ends of the base member are rollers or cam followers 22, 22, for reason which will be hereinafter set forth. As seen in FIG. 4, the support arm 21 is provided with an extended reduced portion 21A.

In accordance with this invention an article support member or table 23 is arranged to be slidably supported on arm 21. As best seen in FIGS. 4, 5 and 6 the article support pallet or table 23 comprises a rigid backing member 24 to which there is adhesively secured a layer 25 of closed cellular material, e.g., polyurethane, which may take the form of a resilient pad. Over the polyurethane layer 25 there is disposed a smooth covering 26 of any suitable material. Connected to the undersurface of the rigid backing 24 are opposed rails, or guides 27. Extended between the guides 27 are spaced crossmembers 28, 29. Thus the table or article support defines a slide which can be readily slipped onto the support arm 21.

A readily releasably locking means is provided to releasably lock the article support 23 to the support arm 21 of the pallet means. As seen in FIG. 4, the locking means comprises a lock pin 30 retained in a bore formed in support arm 21. The lock pin 30 is biased by a spring 31 so that the end of the pin 30 normally projects beyond the side of the arm 21. The portion of the article support 23 when disposed on the arm 21 is provided with a notch 32 in which the projecting end of the pin 30, which serves as a catch, seats when the article support is properly positioned on the arm 21. The end of the pin 30 and the notch 32 are formed with complementary cam surfaces so that the pin 30 and notch 32 automatically engage when alignment therebetween occurs as the table or article support 23 is slipped onto the arm 21. Also by exerting a predetermined pull force on the table or article support 23, the shape of the notch will cause the lock pin 30 to be cammed inwardly to effect release of the article support 23 from its support arm 21. It will be understood that one or more locking pins and complementary notches may be utilized; as shown in FIG. 4, four such locking pins are shown.

To prohibit whipping of the respective pallets as they round the sprockets 14 and 15 of the endless chain drive, anti-whipping means are cooperatively associated with each pallet means. Referring to FIG. 3, the anti-whipping means includes opposed brackets 33, 33 which are fixed to the drive chain. As shown the respective brackets 33, 33 are angled and have connected thereto a bumper 34 arranged to engage the opposed sides of the base member 20. The arrangement is such that as the respective pallet means 19 round the end sprocket 14 or 15, that the bumper 34, 34 cushion the base member, thereby absorbing much of the impact due to the abrupt change in the direction of travel of the respective pallet means.

If desired, a support plate 35 may be secured to the base member 20 to underlie the article support 23. The function of the support plate 35 is to support that portion of the work piece or article W not being printed, e.g., the sleeves of a T-shirt and the like.

Figure 7:
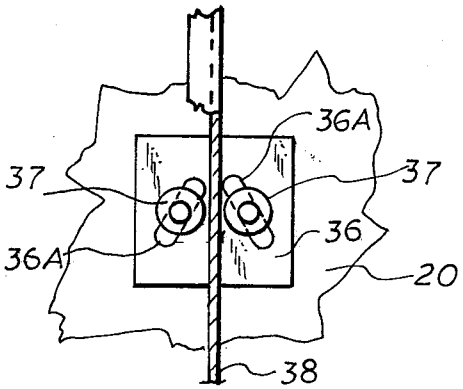
FIG. 7 is a bottom plan view of a detail of construction taken along line 7—7 on FIG. 2.

To laterally stabilize the respective pallet means as they are indexed along the upper flight portion of the endless drive, there is provided along the underside thereof a stabilizing means. Referring to FIGS. 2 and 7, the stabilizing means includes a mounting plate 36 secured to the underside of the base member 20. Adjustably mounted in suitable elongated slots 36A formed in plate 36 are opposed guide rollers 37, 37. The respective guide rollers 37, 37 are disposed to straddle a guide rail 38 that extends longitudinally along the frame 11 of the apparatus. By adjusting the guide rollers 37, 37 to close tolerance to the guide rail 38, it will be apparent that the respective pallet means 19 are laterally stabilized as they are indexed along the upper flight of the endless drive.

To support the respective pallet means traveling along the bottom flight of the endless drive 13, there is provided a pair of opposed support rails 39, 39. The respective support rails 39, 39 are secured to the machine frame 11. The respective support rails 39, 39 are spaced so that the rollers 22—22 connected to the ends of the base member 20 are disposed in rolling engagement with the support rails 39, 39. In this manner the weight of the pallet means is not taken up by the drive chain, but by the support rails 39, 39.

The apparatus described is particularly suitable for screen printing T-shirts and/or discrete cut pieces of fabric. In operation the article to be printed W is positioned on the table portion 23 of the pallet means 19. The end drive 13 is then activated to index the pallet to the printing station. In the printing station the screen and associated squeegee are moved into printing position wherein the screen print is imparted to the article. One or more printing stations may be provided depending upon the number of colors being printed.

With the construction described the pallets are laterally stabilized as they are indexed from station to station. Also the respective article supports 23 are releasably secured so that they can be readily interchanged. Also, banging of the pallets as they round the end portions of the endless drive 13 is obviated by the chain bumpers 34. Further, the stretching of the drive chain is obviated by supporting the pallets along the lower flight on support rails 39.

While the present invention has been described with respect to a particular embodiment thereof, it will be appreciated that variations and modifications may be made without departing from the spirit or scope of the invention.

What is claimed is:

1. A screen printing machine having a frame, a printing head mounted on said frame to define a printing station, and an endless flexible drive extending along said frame, the improvement comprising a plurality of pallet members connected to said endless drive at spaced intervals therealong, each of said pallet members including a base member connected to said endless drive, a support arm connected to each said base member and extending in spaced overlying relationship with respect to said base member, said space being greater than the thickness of said support arm, an article support pallet slidably mounted on each said support arm, and means for releasably locking each said article support pallet to each said corresponding support arm.

2. The invention as defined in claim 1, wherein each said article support pallet comprises a rigid backing member, a resilient pad secured to said backing member, a pair of opposed guides connected to the underside of said backing member, and cross-members connected to said guides to define a slideway, whereby each said article support pallet can be slidably mounted on each said corresponding support arm.

3. The invention as defined in claim 1, wherein each said locking means comprises a spring loaded pin to define a catch, a complementary notch for receiving said pin, and said pin and complementary notch being located on each said article support pallet and each said associated supporting arm.

4. The invention as defined in claim 2, including means for laterally stabilizing said pallet member with respect to said frame as said pallet member is driven along said frame upon actuation of said flexible drive.

5. The invention as defined in claim 4, wherein said lateral stabilizing means includes a guide rail extending along the length of said frame, opposed rollers connected to each said base member, and said opposed rollers straddling said guide rail and being in substantial contact therewith.

6. The invention as defined in claim 4, including means for adjusting said rollers relative to said guide rail.

7. The invention as defined in claim 1, wherein said endless drive comprises a pair of spaced apart endless drives, each of said endless drives having spaced apart upper and lower flight portions, each said base member of the respective pallet members being connected to said spaced apart drives, each said base member extending transversely of said drives, opposed rollers connected to the ends of each base member, support rails mounted on said frame adjacent the lower flight portion of the respective drives, and said rollers being supported on said support rails as said pallet members travel along the lower flight portion of said drives.

8. The invention as defined in claim 1, including opposed end members over which said endless drive is threaded, bumper members connected to said endless drive at spaced intervals therealong, said bumper members including brackets connected to said drive so as to be disposed on opposite sides of said base member immediately adjacent thereto, and a resilient bumper connected to each of said brackets whereby said bumper members are in contacting engagement on opposite sides of said base member during advancement of said base members along said endless drive so as to minimize said whipping action of said pallet members as pallet members complete rounding the opposed end members over which said drive is threaded.

9. An improved screen printing machine comprising a frame, a printing head mounted on said frame, an endless drive mounted on said frame, said endless drive including opposed end sprockets rotatably journaled on said frame, a drive chain threaded over said sprockets to define an upper flight and a lower flight, a plurality of pallet members connected at spaced intervals along said drive chain, each of said pallet members including a base member connected to said chain drive, a support arm connected to said base member and extending in spaced overlying relationship thereto, said space being greater than the thickness of said support arm, an article support pallet slidably mounted on said arm, means for releasably locking said pallet to said arm, said locking means including a spring loaded pin on said arm, and a complementary catch formed on said support pallet, means for laterally stabilizing said pallet members with respect to said frame when said chain drive is actuated, means for supporting said pallet members as they are advancing along the lower flight of said chain, and means for minimizing whipping of said pallet members as said pallet members round said end sprockets.

10. In combination a screen printing machine comprising a frame, a printing head mounted on said frame to define a printing station, a plurality of pallet members, each of said pallet members including a base member connected to said endless drive having a portion extending substantially normal thereto, said base member having a raised portion adjacent one end thereof, a laterally extending arm connected to said raised portion, said arm being spaced from said base portion extending normal to said endless drive, an article support surface slidably mounted on said laterally extending arm, means for releasably locking said article support surface to said arm, means for sequentially advancing said pallet members to said printing station, said advancing means including an endless flexible drive having an upper flight portion and a lower flight portion, means for laterally stabilizing said pallet members with respect to said frame as they advance to and from said printing station, means for supporting said pallet members advancing along the lower flight of said endless drive, and means connected to said endless drive adjacent each side of said pallet members for minimizing any whipping action of said pallet members as said pallet members round the ends of said endless drive.

11. The invention as defined in claim 10, wherein said lateral stabilizing means includes a guide rail extending longitudinally of said frame, a pair of rollers connected to the underside of said base member, and said rollers straddling said guide rail and in substantial contact therewith to laterally stabilize said pallet members with respect to said frame as said pallet members advance along the upper flight portion of said endless drive.

12. The invention as defined in claim 11, wherein said support means include opposed support rails mounted on said frame adjacent the lower flight portion of said endless drive, opposed rollers connected to the ends of said base member, and said rollers engaging said support rails as said pallet members advance along the lower flight of said endless drive.

13. The invention as defined in claim 12, wherein said means for minimizing whipping comprises bumper members connected to said drive, said bumper members being disposed on either side of said base member whereby said bumper members are in contacting engagement on opposite sides of said base member during advancement of said base members along said endless drive so as to minimize said whipping action of said pallet members as said pallet members complete rounding the ends of said endless drive.

* * * * *

UNITED STATES PATENT OFFICE

CERTIFICATE OF CORRECTION

Patent No. 3,977,322 Dated August 31, 1976

Inventor(s) David Jaffa

It is certified that error appears in the above-identified patent and that said Letters Patent are hereby corrected as shown below:

Column 5, line 36, "2" should read -- 1 --.

Signed and Sealed this

Ninth Day of November 1976

[SEAL]

*Attest:*

RUTH C. MASON
*Attesting Officer*

C. MARSHALL DANN
*Commissioner of Patents and Trademarks*